US005310280A

United States Patent [19]

Hara

[11] Patent Number: 5,310,280

[45] Date of Patent: May 10, 1994

[54] SUBSOIL STRUCTURE FOR SODDED GROUND

[75] Inventor: Hiroshi Hara, Amagasaki, Japan

[73] Assignee: Parumo Kabushiki Kaisha, Amagasaki, Japan

[21] Appl. No.: 957,910

[22] Filed: Oct. 8, 1992

[51] Int. Cl.[5] ..... E02B 11/00

[52] U.S. Cl. ..... 405/38; 405/50; 405/55

[58] Field of Search ..... 405/38, 39, 43, 44, 405/45, 49, 50, 51, 270, 53, 55

[56] References Cited

U.S. PATENT DOCUMENTS 4,881,846 11/1989 Burkstaller ..... 405/38 X
4,913,596 4/1990 Lambert ..... 405/45 X
4,966,492 10/1990 Poyda ..... 405/38 X
5,026,207 6/1991 Heath ..... 405/38 X
5,074,708 12/1991 McCann, Sr. ..... 405/43 X
5,076,726 12/1991 Heath ..... 405/38

*Primary Examiner*—Randolph A. Reese
*Assistant Examiner*—J. Russell McBee
*Attorney, Agent, or Firm*—Antonelli, Terry, Stout & Kraus

[57] ABSTRACT

A subsoil structure for sodded ground comprising a water-retaining layer filling a pan-like cavity, a sand layer covering the water-retaining layer, and a soil-improving layer covering the sand layer and incorporating a soil-improving material which is of a porous structure.

Since the soil-improving layer has a good water-retentivity and the water-retaining layer is provided for retaining or storing water, the number of watering times can be extremely reduced, thereby saving time and labor for watering.

5 Claims, 1 Drawing Sheet

SUBSOIL STRUCTURE FOR SODDED GROUND

BACKGROUND OF THE INVENTION

The present invention relates to a subsoil structure for sodded ground, and more particularly to a subsoil structure for a putting green in a golf course, which subsoil structure has good water- and fertilizer-retentivity while being excellent in water-permeability. By such structure the number of watering times can be extremely reduced, while even in the case of rain fertilizers and the like can be prevented from flowing out.

Conventionally, drainage for a putting green in a golf course has been conducted with the use of a drain pipe 10 buried under the green, as shown in FIG. 2. As the drain pipe 10 is used a synthetic resin pipe, unglazed ceramic pipe or the like which is provided with a multiplicity of apertures in the circumferential wall thereof. The diameter of the drainage pipe 10 depends upon whether or not the district where the golf course is situated is rich in rainfall, the area of the putting green or the like. However, in general a branch pipe 10*a* has a diameter of about 5 to 10 cm, while a trunk pipe 10*b* has a diameter of about 10 to 15 cm. Rainwater penetrating into the green is introduced into the branch pipe 10*a* through the apertures in the circumferential wall thereof, collected to the trunk pipe 10*b*, and concentratedly drained at one or two spots.

However, most of the putting greens now available are of sabulous green in which much sand is used to prevent root rot of grass. For this reason, with the concentrated drainage system using the buried drainage pipe, even a small amount of rain rapidly penetrates the sand layer and easily flows out. Agricultural chemicals or fertilizers that are used to maintain or control the grass also flow out together with the rainwater. This results in one of the causes accounting for environmental pollution in areas downstream of the golf course.

In summer especially, watering the putting green is required for growing and maintaining the grass. With the conventional concentrated drainage system, however, a sabulous sand green of bent grass would require watering at least about twice per day in summer, even if a water-retaining material such as perlite or pumice is incorporated as an improving material in the sabulous green. Such watering requires time and labor.

In view of the above-mentioned circumstances, an object of the present invention is to provide a subsoil structure for sodded ground, which is capable of preventing an easy outflow of agricultural chemicals or fertilizers and extremely reducing the number of watering times.

SUMMARY OF THE INVENTION

In accordance with the present invention, there is provided a subsoil structure for sodded ground comprising a water-retaining layer filling a pan-like cavity, a sand layer covering the water-retaining layer, and a soil-improving layer covering the sand layer and incorporating a soil-improving material which is of a porous structure.

DETAILED DESCRIPTION

Hereinafter, a subsoil structure for sodded ground according to the present invention will be described in more detail with reference to the drawings.

Figure 1:
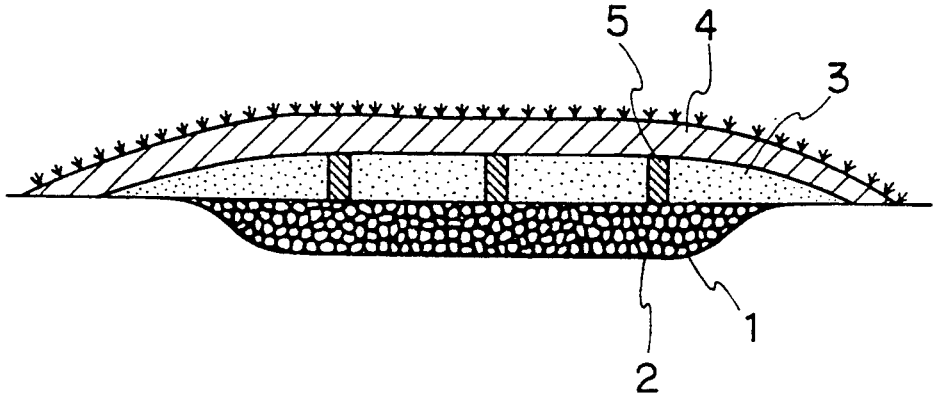
FIG. 1 is a schematic sectional view illustrating a subsoil structure for sodded ground embodying the present invention.
Figure 2:
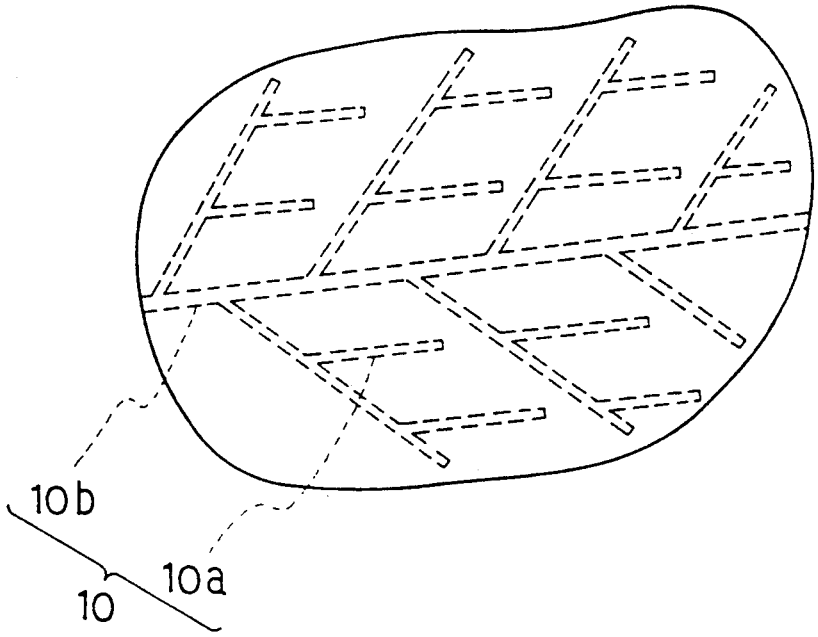
FIG. 2 PRIOR ART
FIG. 2 a schematic plan view illustrating a conventional subsoil structure for sodded ground.

FIG. 1 is a schematic sectional view illustrating a subsoil structure for sodded ground embodying the present invention.

Referring to FIG. 1, numeral I denotes a water-retaining layer filling a pan-like cavity 2. The cavity 2 is formed substantially flat in the center portion thereof in view of a desired configuration of a putting green and has a depth larger than that of a hole cup. In general the depth of the cavity 2 is about 30 to 50 cm. The water-retaining layer 1, which fills the cavity 2, serves to retain or store rainwater or watered water while playing a roll of decomposing the fertilizers or agricultural chemicals applied to the putting green. For this reason, if there is a relatively large amount of rainfall, the rainwater is prevented from flowing out quickly to the areas downstream of the golf course. As well, thanks to decomposition of the chemicals or the like by microorganisms, outflow of the chemicals or the like to exterior is mitigated. In addition it becomes possible to reduce the number of watering times by utilizing the water retained in the water-retaining layer. The water-retaining layer 1 can be formed of stone or concrete spalled to about 3 to 4 cm in size, sand, pebbles and the like. It should be noted that a drainage pipe (not shown) can be provided on the water-retaining layer 1.

A sand layer 3 is formed on the water-retaining layer 1. The sand layer 3 serves to make differences in height so as to hormonize with the topography of surroundings. The sand layer 3 can be formed of sand or decomposed granite having a particle size of about 0.5 to 2 mm. The thickness of the sand layer 3 is not particularly limited in the present invention, but typically about 10 to 20 cm.

On the sand layer 3 is provided a soil-improving layer 4 incorporating a soil-improving material obtained by burning diatamaceous earth at a high temperature of about 1100° to 1200° C. to turn it into ceramic. The soil-improving material is of a porous structure having numerous fine pores and has, hence, a characteristic of very excellent water-permeability and water- and fertilizer-retentivity. It is preferable that the soil-improving material should be shaped columnar having, for example, a diameter of about 1 mm and a length of about 3 mm, rather than spherical in order to prevent it from moving to disappear. This is because the columnar material can be more readily lodged by grass rather than the spherical one.

As the soil-improving material, there can be employed, besides the above-mentioned one obtained by burning dialomaceous earth at a high temperature, ones of a porous structure such as zeolite, peat-moss, pumice stone, activated carbon, and burned clay.

The soil-improving layer 4 might incorporate, as well as the soil improving material, park compost, charcoal and the like. Although the mixing rate of these components is not particularly limited in the present invention, it is preferable that the soil-improving material should be incorporated in an amount of about 10 to 20 wt. % in the soil-improving layer 4 in view of the water-permeability, water-retentivity and air-permeability.

The sand layer 3 might be provided therein with a water-absorption part 5 which is columnar and provides a connection between the water-retaining layer 1 and the soil-improving layer 4. The water absorption part 5 is formed of the aforesaid soil-improving material of a porous structure such as diatomaceous earth burned at a high temperature and functions as a sort of water path for leading the water stored in the water-retaining layer 1 to the soil-improving layer 4, thereby contributing to enhancement of the water-absorptivity of the putting green. The sectional area of one water-absorption part 5 is usually 70 to 200 $cm^2$, and it is preferable that one water-absorption part should be provided in an area of 3 to 4 $m^2$.

According to the subsoil structure for sodded ground of the present invention, watering, which has been needed once or twice per day, can be reduced to once per 4 to 7 days.

As has been described, in the subsoil structure for sodded ground according to the present invention, the water-retaining layer as the lowermost layer is formed beneath the surface of a putting green, while the soil-improving layer as the top layer incorporates the soil-improving material of a porous structure excellent in water-permeability and water- and fertilizer-retentivity. Thus, the subsoil structure of the present invention enjoys the following effects:

1. It is becomes possible to extremely reduce the number of watering times, thus leading to saving of time and labor for watering, because the soil-improving layer, per se, has a good water-retentivity, while at the same time the water-retaining layer is provided for retaining or storing water therein.

2. Since a relatively large amount of rainwater can be retained or stored in the water- retaining layer, it is possible to prevent fertilizers or agricultural chemicals applied to grass from flowing out together with the rainwater to the areas downstream of the golf course. As a result, environmental pollution due to the fertilizers or agricultural chemicals can be assuredly prevented.

It should be understood that although the subsoil structure for sodded ground of the present invention is applied to a putting green of a golf course in the embodiment, it can be used for a sodded garden or a like place.

What is claimed is:

1. A subsoil structure for storing water beneath sodded ground to reduce the frequency of needed watering, said subsoil structure comprising a pan-like cavity, a water-retaining layer filling the pan-like cavity for storing water therein with no drain pipes within the water-retaining layer in the cavity, a sand layer covering the water-retaining layer, and a soil-improving layer covering the sand layer and incorporating a soil-improving material which is of a porous structure.

2. The subsoil structure for sodded ground of claim 1, wherein the soil-improving material is obtained by burning diatomaceous earth at a high temperature.

3. The subsoil structure for sodded ground of claim 1, wherein the sand layer has at least one columnar water-absorption part connecting the water-retaining layer and the soil-improving layer, the water-absorption part being formed of the same material as the soil-improving material.

4. The subsoil structure for sodded ground of claim 3, wherein the soil-improving material is obtained by burning diatomaceous earth at a high temperature.

5. The subsoil structure for sodded ground of claim 1, wherein said water-retaining layer is the lower most layer of said subsoil structure.

* * * * *